US005462196A

United States Patent [19]

Hotkowski

[11] Patent Number: 5,462,196

[45] Date of Patent: Oct. 31, 1995

[54] HOPPER AND FEED FOR PLASTIC BOOK-BINDING STRIPS

[75] Inventor: Peter Hotkowski, Old Saybrook, Conn.

[73] Assignee: VeloBind, Incorporated, Northbrook, Ill.

[21] Appl. No.: 237,059

[22] Filed: May 3, 1994

[51] Int. Cl.[6] ..... G07F 11/60

[52] U.S. Cl. ..... 221/1; 221/11; 221/106; 221/198; 221/226; 221/230; 221/262; 221/270; 221/287

[58] Field of Search ..... 221/1, 11, 103, 221/104, 106, 110, 198, 224, 226, 230, 236, 262, 270, 287, 312 C

[56] References Cited

U.S. PATENT DOCUMENTS

| | | | |
|---|---|---|---|
| 4,674,906 | 6/1987 | Abildgaard | 402/80 |
| 4,844,674 | 7/1989 | Tipps et al. | 412/43 |
| 4,846,616 | 7/1989 | Abildgaard et al. | 412/7 |
| 5,017,071 | 5/1991 | Todaro et al. | 412/43 |
| 5,046,641 | 9/1991 | Gray | 221/287 X |
| 5,207,351 | 5/1993 | Lesar | 221/224 X |
| 5,383,756 | 1/1995 | Coleman et al. | 412/38 |

*Primary Examiner*—William E. Terrell
*Assistant Examiner*—Dean A. Reichard
*Attorney, Agent, or Firm*—Julian Caplan; Flehr, Hohbach, Test, Albritton & Herbert

[57] ABSTRACT

Plastic binding strips used with this invention comprise a female strip consisting of a narrow, thin plastic strip formed with spaced apertures and grooves communicating with the apertures and a male strip comprising a narrow plastic strip having bendable studs projecting at fight angles therefrom spaced to fit through holes in the pages to be bound and the apertures in the female strip. Such strips are packaged in cassettes. The hopper for the female strips receives a stack of cassettes. Strips are fed from the lowermost cassette by a horizontally reciprocating finger onto a transverse ways and then feed along the ways to an assembly station. When the lowermost cassette is empty, its support is removed and the next cassette is moved into place. The male hopper is similar to the female except that the studs require greater spacing between cassettes and provision is made in the feed structures for the upward projection of the studs.

29 Claims, 10 Drawing Sheets

HOPPER AND FEED FOR PLASTIC BOOK-BINDING STRIPS

CROSS REFERENCES TO RELATED APPLICATIONS

Reference is made to pending U.S. Pat. application Ser. No. 08/197,033, now U.S. Pat. No. 5,383,756, filed Feb. 15, 1994, which is a continuation of application Ser. No. 07/975,460 filed Nov. 12, 1992, now abandoned. The above application, owned by the assignee of this application, relates to a cassette for book-binding strips. The present invention is an apparatus and method for removing binding strips from such a cassette.

BACKGROUND OF THE INVENTION

1. Field of the Invention

This invention relates to a new and improved hopper and feed mechanism for plastic binding strips packaged in cassettes wherein the strips are fed one at a time from the cassette onto a transfer table and then fed laterally to an assembly station where the strips and prepunched paper are assembled and subsequently bound. The invention further relates to a method of feeding cassettes and strips into the assembly station of an automatic binding machine.

2. Description of the Related Art

Automatic binding machines with which the present invention are used are disclosed in such prior U.S. Pat. Nos. as 5,017,071 and 4,846,616 (see particularly FIGS. 6–10 thereof). These prior binding machines use cassettes of the type shown in U.S. Pat. No. 4,844,674. The present invention comprises a portion of an automatic binding machine (i.e., the hopper for cassettes and the feed means for feeding the strips from the cassettes and into the assembly station) using an improved cassette such as is shown in U.S. application Ser. No. 08/197,003.

SUMMARY OF INVENTION

The machine and method hereinafter described uses a pair of thin plastic binding strips. The female strip has longitudinally spaced holes and grooves in one surface of the strip communicating with the holes. The male strip has studs spaced at the same intervals as the holes, which studs may be bent approximately at right angles and snapped into the grooves in the female strip. The two strips are placed on opposite sides of the spine edges of punched sheets and bind the sheets together.

The hopper of the present invention accepts cassettes of the type shown in U.S. application Ser. No. 08/197,033 in which female strips and male strips are packaged for transportation and storage.

The machine of the present invention comprises a hopper into which cassettes are stacked. As one cassette is emptied, the next cassette in order is moved into discharge position. A motor drives four wheels—two on each side of the machine—in timed relation and equi-angularly, the wheels being provided with pegs which ensure that only one cassette is fed at a time. A latch in the cassette which prevents strips from being prematurely discharged is opened by means associated with the cassette feed mechanism.

A pair of fingers engage the rearward edge of the rearmost strip in the cassette and moves it forward one space at a time, thereby pushing the preceding strips one at a time out of the cassette and onto a platen and hold-down mechanism. An air cylinder controls movement of four supports—one located at each corner of the cassette—which hold the cassette from dropping and also hold the upper edge of a portion of the cassette to prevent upward displacement. These supports are retracted when the next cassette is moved into position and are then moved into operative position to support the next cassette and also to open the latch.

A strip drive mechanism moves a carriage mounted on longitudinal ways. Attached to the carriage is a magnet-sensitive member which surrounds a longitudinally extending pneumatic cylinder. Within the cylinder is a magnet which is driven in steps longitudinally of the cylinder and causes the carriage to move therewith. Projecting up from the carriage are two uprights, the upper ends of which comprise forwardly directed fingers which engage the rear edge of the rearmost strip in the cassette and push all of the strips forward one position for each movement of the magnet in the cylinder. As the strips reach the forward end of the cassette they are guided by guides which confine the strips as they are pushed one at a time onto a transverse strip feed.

The transverse strip feed comprises an air cylinder which moves a magnet longitudinally thereof. A magnet-sensitive member surrounds the air cylinder and is connected to a member which contacts one end of the strip in the transverse feed and moves it laterally along a guideway into an assembly station. Under influence of the magnet in the air cylinder, the member is retracted to its initial position, whereupon the next strip is moved into the transverse feed.

The hoppers for the female strip and the male strip are substantially similar. However, by reason of the studs of the male strips which project upwardly, the vertical feed of the cassettes for the male strips is somewhat more elaborate.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Figure 1:
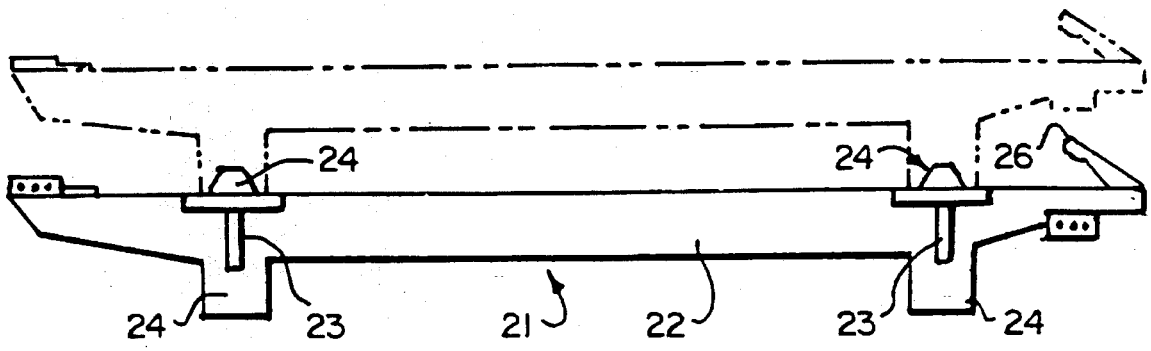
FIG. 1 is a side elevational view of a cassette for female binding strips.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

First described will be a hopper for cassettes packaging female strips. The male strip hopper is in many respects similar, and the differences between such male hopper and the female hopper will hereinafter be described.

Cassettes and Binding Strips

Cassettes 21 in accordance with the present invention have longitudinal members 22 having inwardly facing channels to receive the opposite ends of the strips packaged therein. The members 22 are held in alignment and in spaced relationship by transverse space bars 23. Spacer struts 24 space stacked superimposed cassettes a proper vertical distance apart. At one end of at least one longitudinal member 22 is a latch 26 which fits into the channel in the longitudinal member 22 to prevent unwanted displacement of strips from the cassette 21. It will be understood that the opposite end of the longitudinal member of the cassette is blocked. When latch 26 is opened, it is removed from the channel in longitudinal member 22, thereby permitting discharge of strips therefrom. In accordance with the present invention, the cassettes 21 are stacked on top of each other in a hopper and each cassette is fed into discharge position as the preceding cassette has been emptied. The latch 26 is opened when the cassette reaches discharge position. Cassettes 21 are described in greater detail in U.S. application Ser. No. 08/197,003.

Female cassettes 21 (FIG. 1) package female strips 31 which are space with holes (not shown in the accompanying drawings but well described in U.S. Pat. No. 4,674,906). On one surface of the female strip are grooves communicating with the holes. The grooves are also not illustrated herein but are well illustrated in U.S. Pat. No. 4,674,906.

Figure 2:
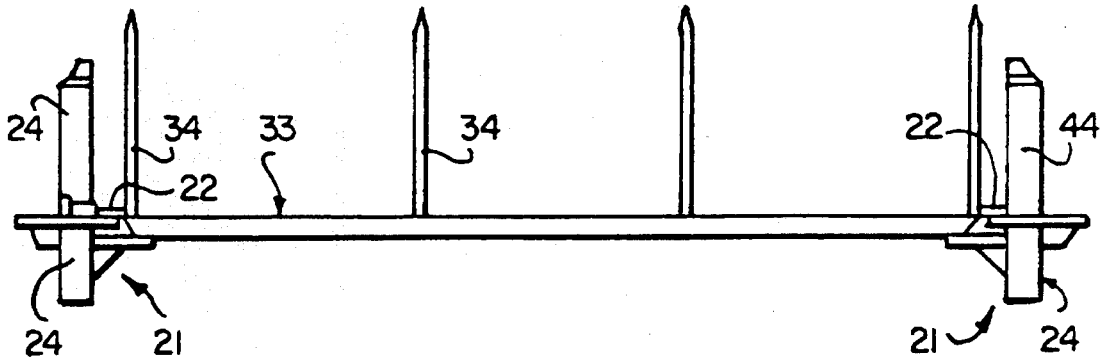
FIG. 2 is an end elevational view of a cassette for male binding strips.

Male strips 33 (FIG. 2) have bendable upstanding studs 34 at the same intervals as the holes in the female strips.

In an automatic book-binding machine, a female hopper is located on one side of the machine and a male hopper on the opposite side. One female strip 31 is moved laterally to a central assembly station and a male strip 33 is likewise moved laterally but in the opposite direction to the assembly station. The punched sheets of paper to be bound are fed into the assembly station and assembled with the female strip 31 on one side of the stack of sheets and the studs 34 of the male strip extending through the holes in the paper and the holes in the female strip. When thus assembled, the studs are bent so that they are snapped into the grooves on the outside surfaces of the female strips, thereby binding the book together. A machine for assembling a book is shown in detail in U.S. Pat. No. 5,017,071.

Cassette Vertical Feed for Female Hopper

Figure 9:
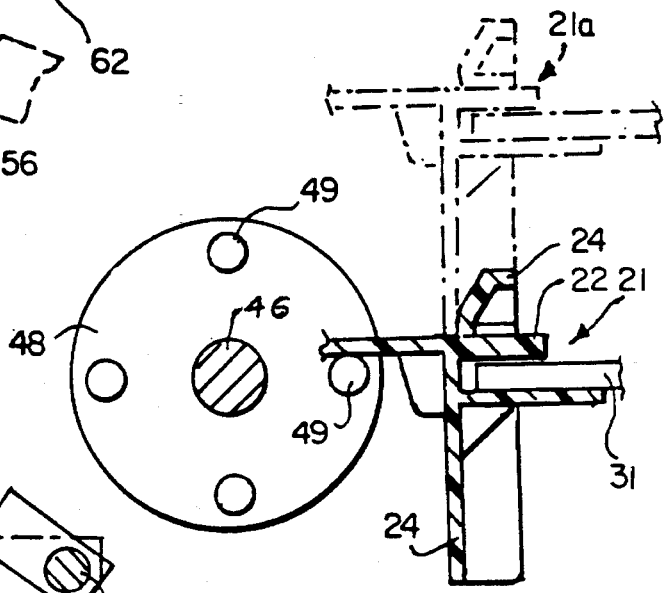
FIG. 9 is a fragmentary sectional view taken substantially along line 9—9 of FIG. 3.

The female hopper comprises a vertical left-side frame 36, an opposed right-side frame 37, a vertical rear frame 38 joined to the rear edges of the sides 36 and 37 and a front crossbar 39 joined to the front edges of the frame members 36 and 37. Legs 40 at suitable intervals position the hopper above a support surface. Horizontal left connector 41 interconnects rear frame 38 and front crossbar 39 to the left of left-side frame 36. Within the hopper are longitudinal cassette guides 43 and transverse cassette guides 44 which are spaced to support a stack of superimposed cassettes 21 so that the cassettes may be moved into discharge position in the hopper one at a time as hereinafter described. Supported inside the side frames 36, 37 are horizontal left shaft 46 and right shaft 47 which carry wheels 48 having projecting pins 49 which feed cassettes 21 downward one at a time (FIG.9). Motor 51 through chain 52 and sprockets 53 turn the shafts 46, 47 equi-angularly in opposite directions. The arcuate distance between pins 49 is equivalent to the height of cassettes 21. The control of the vertical movement of the cassettes as hereinbefore described is one of the differences between the female cassette and the male cassette hereinafter described.

Mounted on the outside of left-side frame 36 is an air cylinder 56. Clevis 57 on the outer end of the rod of cylinder 56 is connected to arm 58 by clevis pin 59. Arm 58 is fixed to transverse horizontal cross-shaft 61 which extends across the machine. A longitudinally extending connector rod 62 is connected to arm 58 by pin 60 at its forward end and is similarly connected at its rearward end to link 63 on the outer end of transverse horizontal rear cross-shaft 64. It will thus be seen that as cylinder 56 is energized, shafts 61 and 64 are oscillated equi-angularly but in opposite directions.

Figure 10:
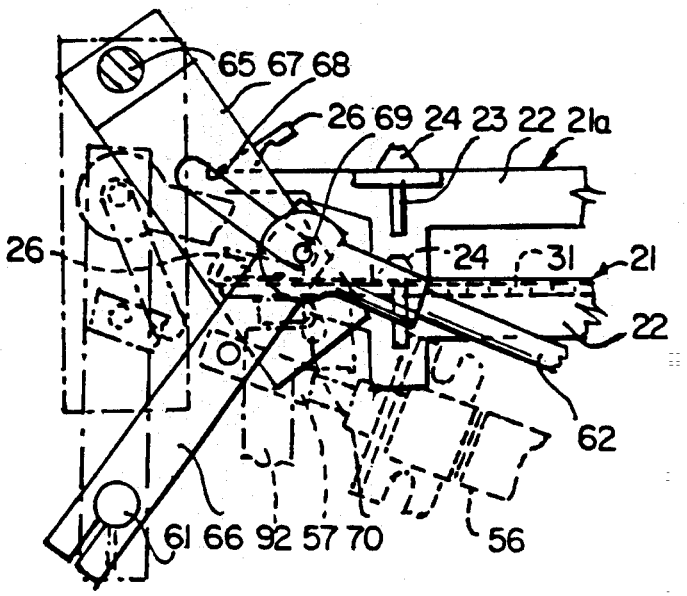
FIG. 10 is an enlarged fragmentary view of a portion of FIG. 7 showing the parts in one position of their cycle of operation in solid lines, and in another position in dot-and-dash lines.

As best shown in FIG. 10, inner forward arm 66 is fixed to shaft 61 on the inside of left-side frame 36. It will be understood that a similar arm is located on shaft 61 inside the fight-side frame 37. Link 67 is pivoted by means of pivot 65 to the frame member 36. Link 67 is formed with a diagonal slot 68 into which pin 69 on arm 66 fits. Thus, as shaft 61 oscillates under control of cylinder 56, link 67 likewise oscillates. Mounted adjacent the lower end of link 67 is a cassette support pin 70. Pin 70 fits under longitudinal member 22 of the cassette 21 which is in discharge position, while pin 69 fits above cassette member 22 to prevent the cassette from being displaced upwardly. When the cassette is in discharge position, the arm 66 and link 67 are in solid-line position. When the cassette 21 has been discharged and the next cassette **21*a* is about to be fed into discharge position, under actuation of cylinder 56 the arm 66 and link 67 are pivoted to dot-and-dash positions, the interconnection between members 66 and 67 by means of pin 69 and slot 68** accommodating such movement.

Figure 11:
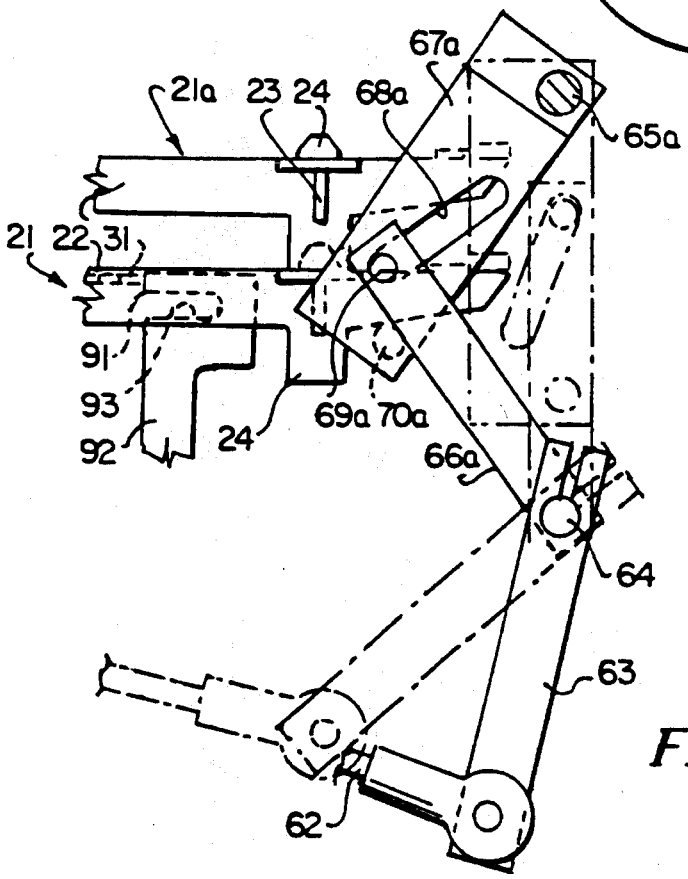
FIG. 11 is an enlarged fragmentary view of a portion of the structure of FIG. 8 showing the parts in one position of their cycle of operation in solid lines, and another position in dot-and-dash lines.
Figure 11A:
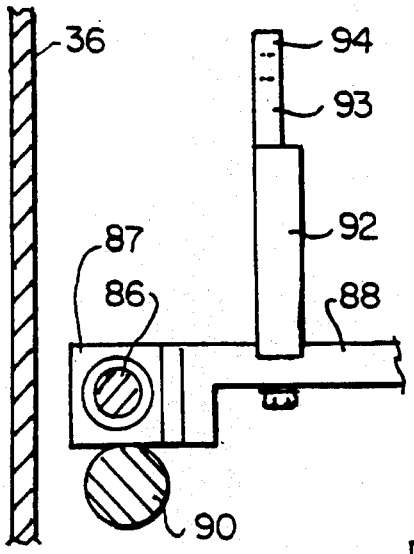
FIG. 11A is a fragmentary sectional view taken along the line 11A—11A of FIG. 3.

FIG. 11 shows similar actuation at the rear of the machine. It will be noted that the slot **68*a* in FIG. 11 is oppositely disposed relative to slot 68 in FIG. 10. In other respects, the elements of FIG. 11 resemble those of FIG. 10** with the subscript "a" added to the corresponding parts.

One of the forward pins 69 is formed with a flattened surface 81. As pin 69 moves to the solid-line position shown in FIG. 10, it engages latch 26 of the cassette 21 in discharge position, opening the latch and permitting discharge of strips 31.

Longitudinal Strip Movement

Forward movement of strips 31 along longitudinal members 22 of cassettes 21 is controlled by longitudinally horizontally mounted strip actuator cylinder 86 which contains therein a magnet which is moved a fixed step distance as the cylinder 86 is actuated. One suitable cylinder and follower is sold by Festo Co. of Hauppauge, N.Y., under the name DGO NM SA Cylinder. Extending horizontally transversely of the hopper is carriage 88 fixed to follower 87 and supported by left support rod directly beneath carriage 88. The right end of carriage 88 has a rest 89 which rides on longitudinally extending horizontal right support bar 91.

Extending upward of carriage 88 are two uprights 92. A slot 93 extends horizontally below the upper end of upright 92 so that there is a finger 94 at the forward upper corner of upright 92. Finger 94, when the cylinder 86 moves carriage 88 forwardly from an initial position at the rear of the machine, engages the rear edge of the rearmost strip 31 in cassette 21. As the carriage 88 is advanced step by step, the strips 31 are pushed forwardly of cassette 21 a distance equal to the width of strip 31.

Figure 12:
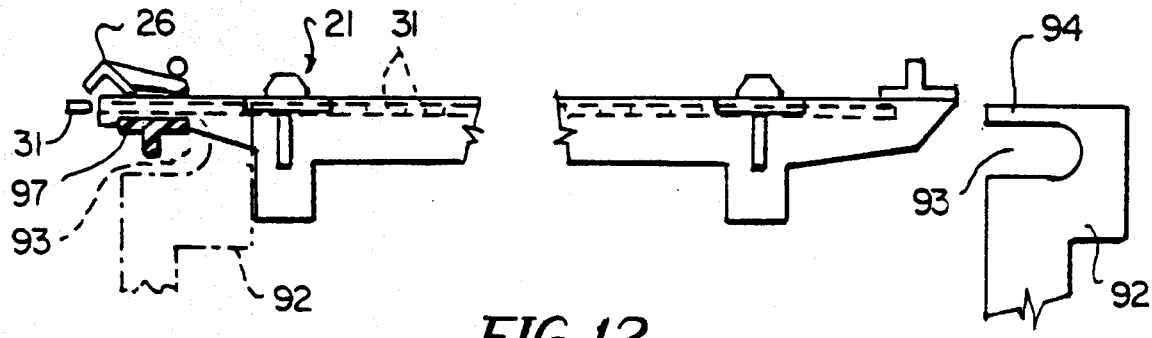
FIG. 12 is a fragmentary sectional view taken substantially along the line 12—12 of FIG. 3.
Figure 14:
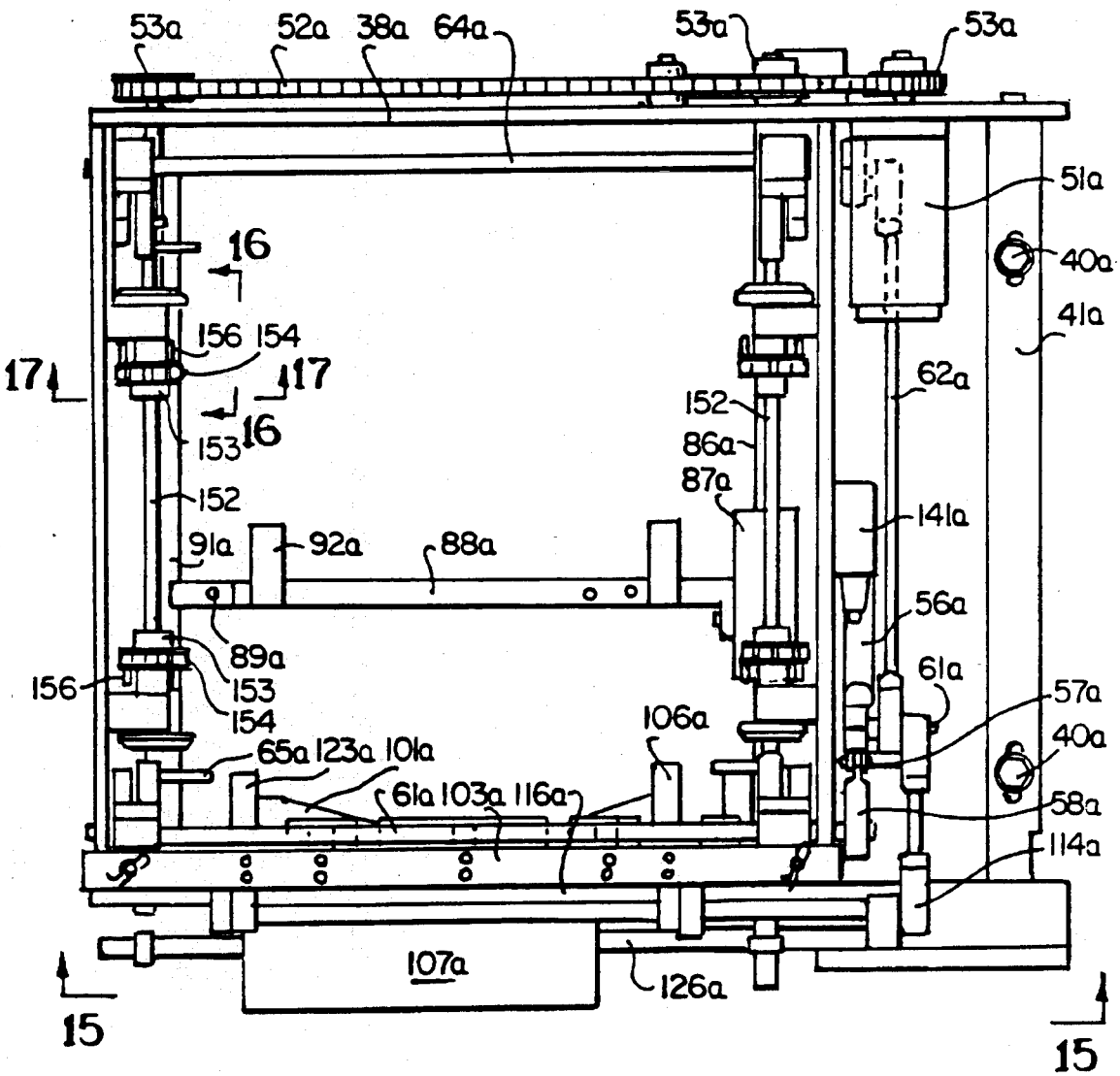
FIG. 14 is a view similar to FIG. 3 of a hopper used with male strips.
Figure 16:
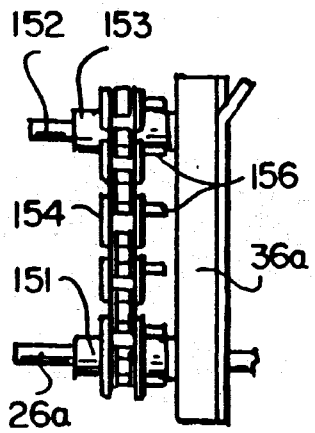
FIG. 16 is a fragmentary elevational view as viewed substantially along the line 16—16 of FIG. 14.
Figure 17:
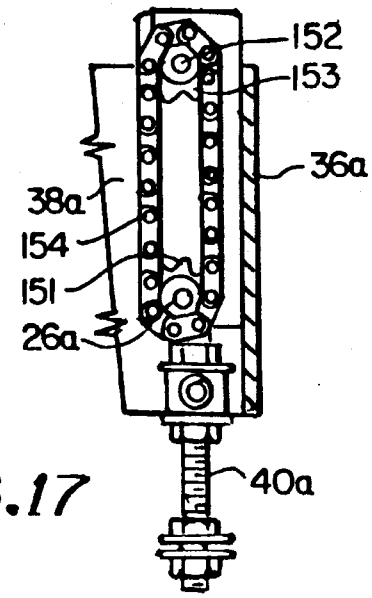
FIG. 17 is a fragmentary sectional view taken substantially along the line 17—17 of FIG. 14.
Figure 15:
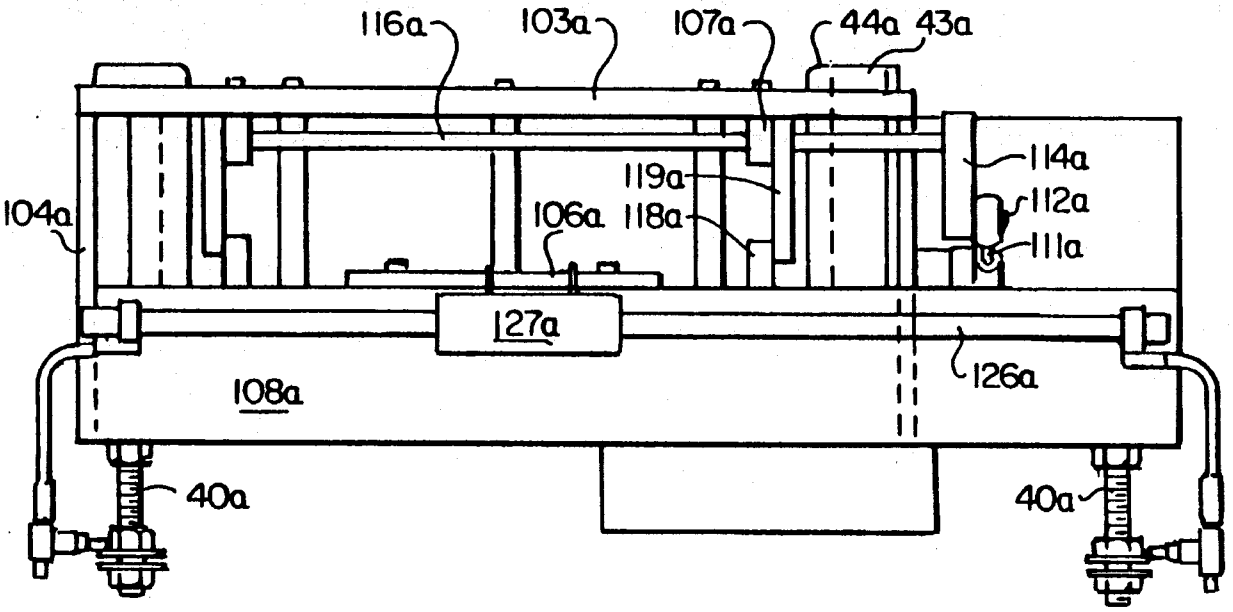
FIG. 15 is a front elevational view taken substantially along the line 15—15 of FIG. 14.

As shown in FIG. 12 there is a cross bar 97 at the front of the hopper under cassettes 21. Finger 94 fits over cross bar 97 to continue to engage strips 31 while slot 93 accommodates cross bar 97.

Figure 3:
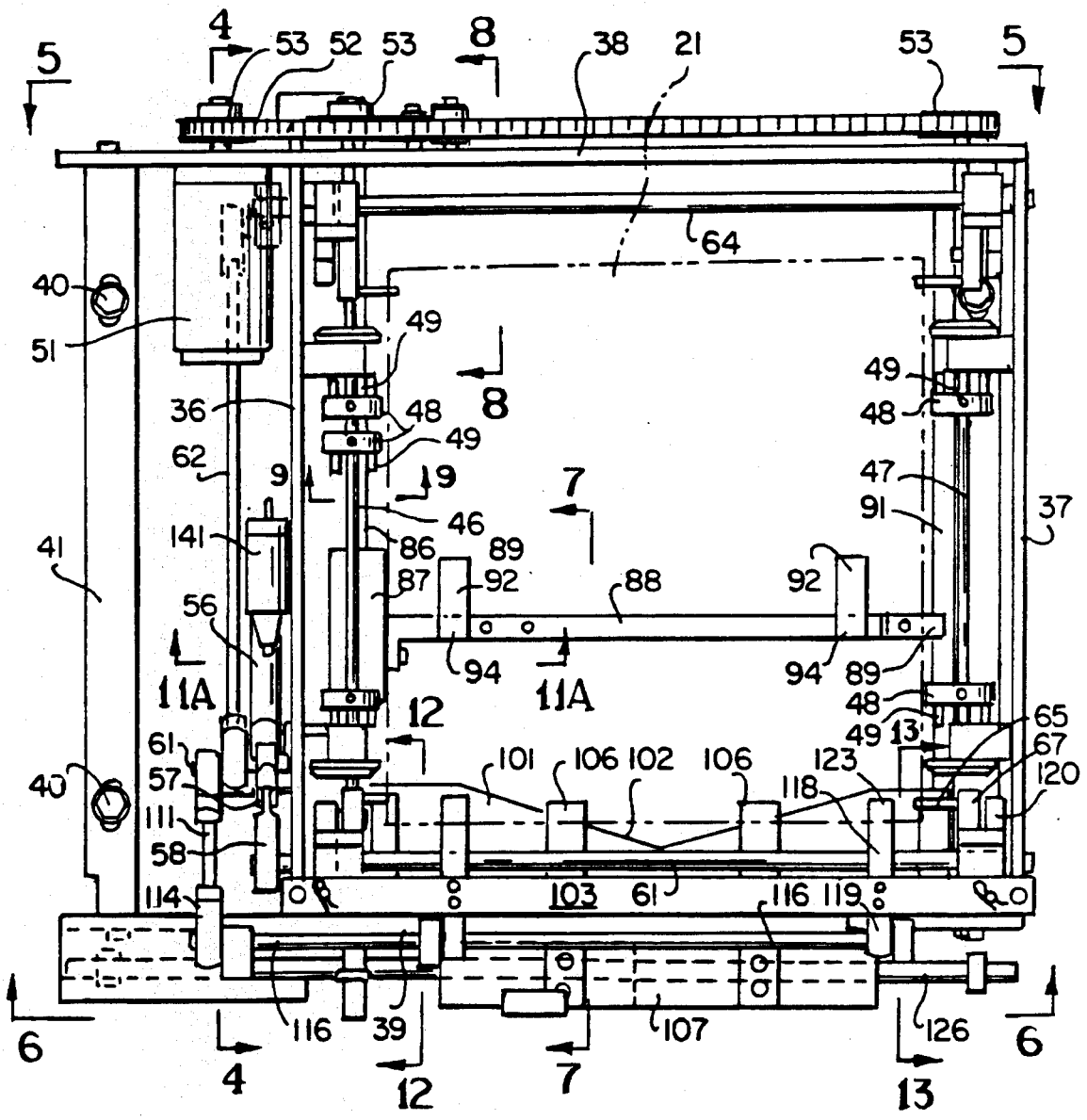
FIG. 3 is a top plan view of a female hopper in accordance with the present invention.

As the strips 31 are pushed out of the cassette 21, one at a time, they ride over horizontal platen 101 located at the forward end of the hopper. Platen 101 is formed with a wide V-shaped notch 102 (see FIG. 3). The strips 31 are held against dislodgement from the platen 101 by means next explained.

Strip Hold-down Means

One means to prevent upward dislodgement of strips 31 from platen 101 is rearward extending, horizontal guides 106 spaced above platen 101 the thickness of strips 31. Guides 106 are attached at their forward ends to transverse horizontal mounting 107 which is, in turn, fixed to transverse horizontal bar 108 at the front of the machine.

Figure 4:
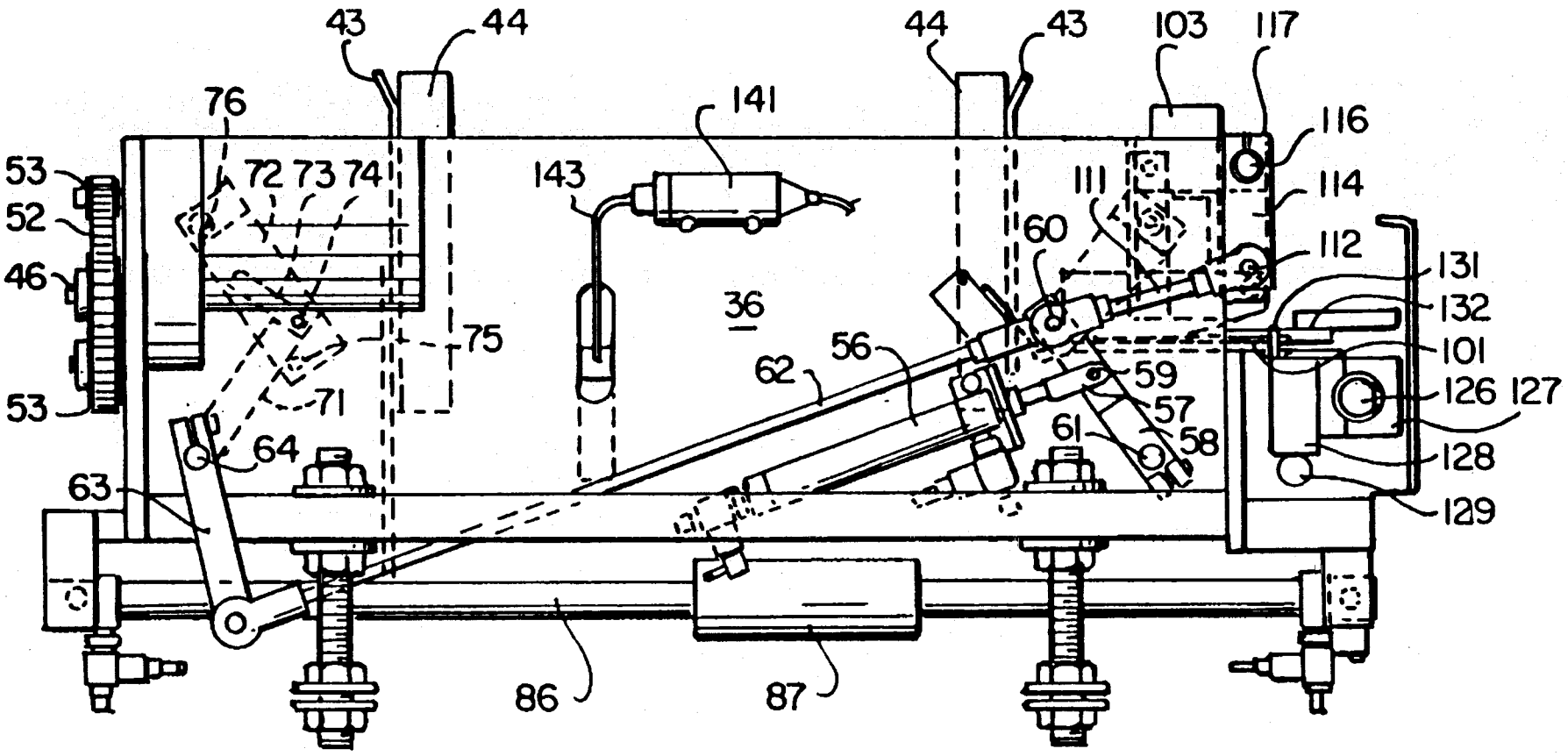
FIG. 4 is a side elevational view taken substantially along the line 4—4 of FIG. 3.
Figure 5:
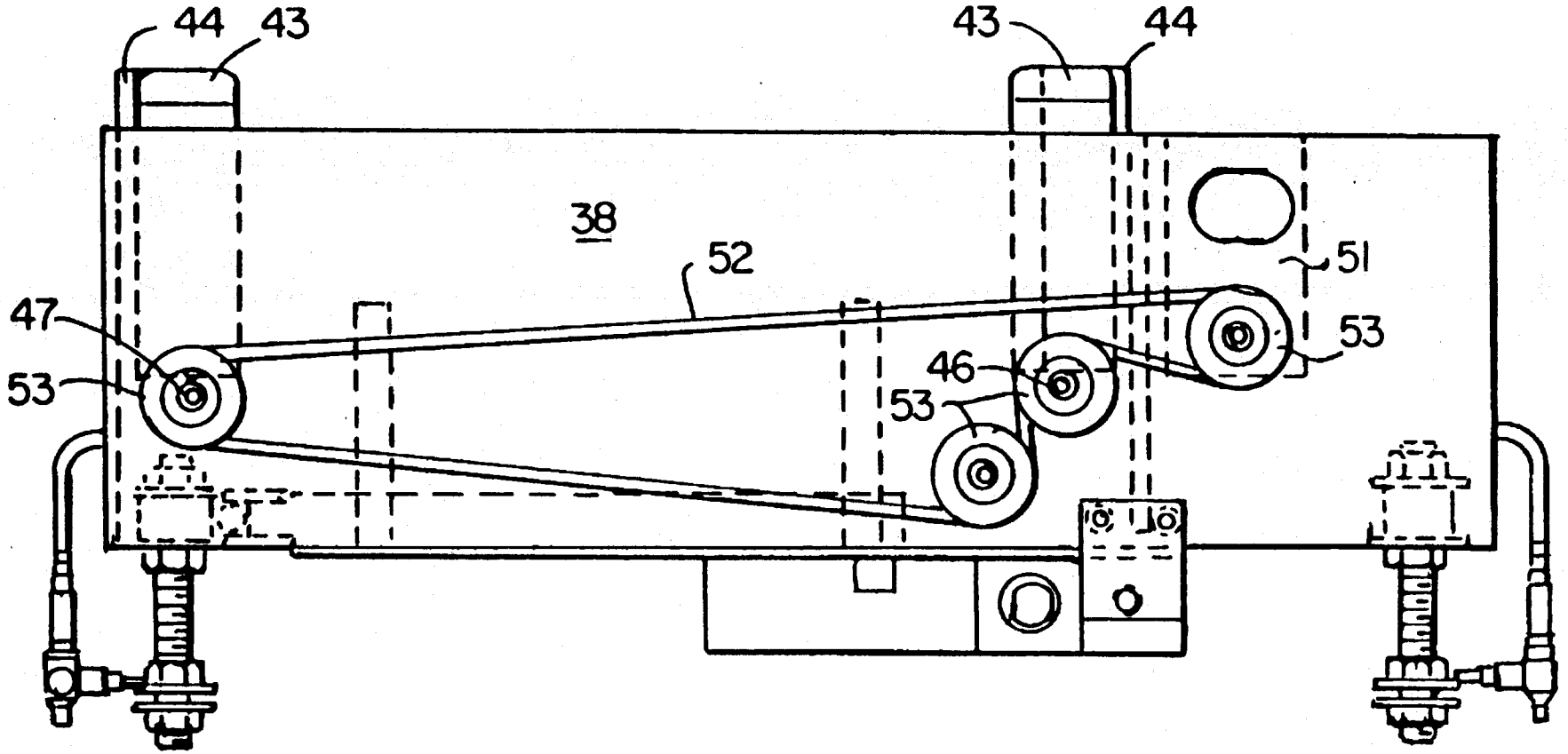
FIG. 5 is a rear elevational view as viewed substantially along the line 5—5 of FIG. 3.
Figure 13:
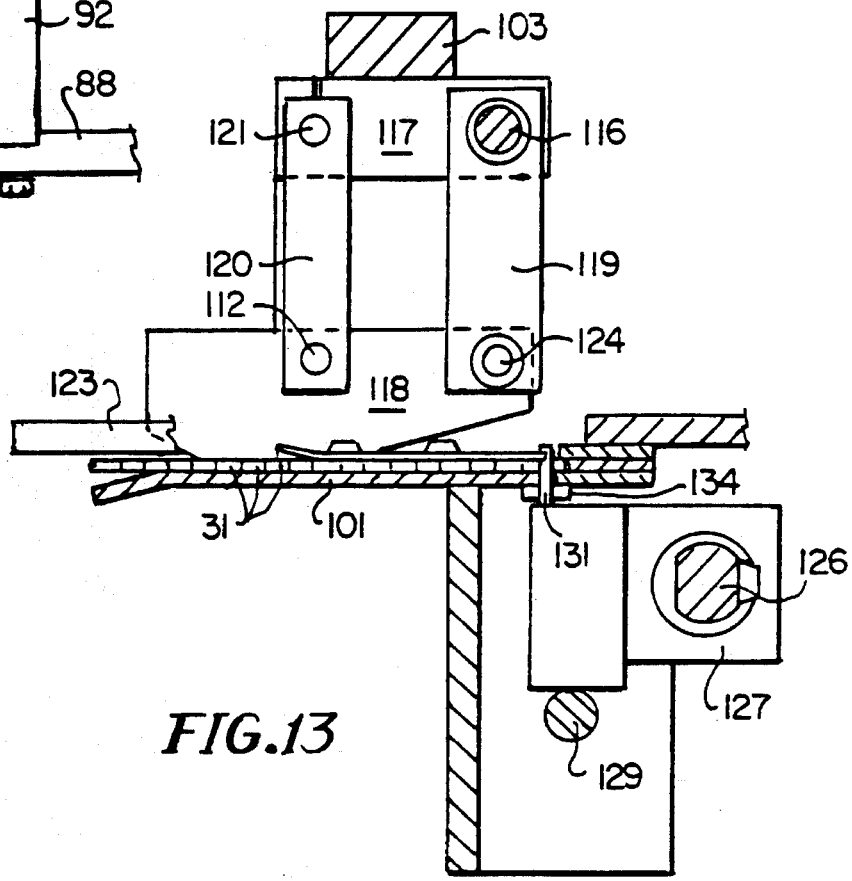
FIG. 13 is an enlarged fragmentary sectional view taken substantially along the line 13—13 of FIG. 3.

An additional means for holding down the strips in contact with platen 101 extends farther rearwardly than guides 106 and is retractable. Thus, directing attention now to FIG. 4, there is an extension 111 of rod 62, the forward end of which is connected by pin 112 to link 114, the upper end of which is fixed to transverse horizontal shaft 116. Hence, as cylinder 56 is actuated, shaft 116 oscillates. Shaft 116 is journaled in horizontal longitudinal support 117 which is connected to horizontal transverse bar 103 mounted well above the level of platen 101. The elevation of bar 103 is necessary in the Male Strip Hopper to accommodate upstanding studs 34 and is desirable in the Female Strip Hopper for uniformity of parts. Fixed to shaft 116 is link 119 which is pivoted to the forward end of hold-down 118 by pin 124. (See FIG. 13) Pivoted to support 117 by pivot 121 is a second link 120, the lower end of which is pivoted by pivot 112 to hold-down 118. Thus, hold-down 118 is oscillated forwardly and rearwardly under the influence of shaft 116. In order to hold down the strips 31 as they are discharged from the cassette 21, there is a horizontal rearwardly extending finger 123 on hold-down 118. In order to prevent finger 123 from interfering with discharging of empty cassette 21 after the strips 31 have been discharged therefrom and feed of the superimposed cassette **21*a* into operative position, hold-down 118 is moved forwardly so that finger 123 clears cassette 21*a*** as it decends.

The forward edge of the strip 31 is pushed against the rearward edge of transverse bar 108, and them is a gap between the bar 108 and the platen 101. Extending horizontally transversely across the front of the machine is cylinder 126 similar in function to cylinder 86 and mounted thereon is a follower 127 similar to follower 87. One suitable cylinder and follower is manufactured by Festo Co. of Hauppauge, N.Y., under the name DGO-12-357-63-PPV-A B SA#15115. Connected to follower 127 is a carriage 128, the bottom of which is supported on transverse rod 129. Projecting upwardly from carriage 128 is pin 131 which carries a pusher 134 which is I-shaped in cross-section and extends up into the gap between the members 108 and 101 (See FIG. 13). After a strip 31 has been positioned against bar 108, cylinder 126 is actuated, causing carriage 128 and pusher 134 to move transversely across the front of the machine, pushing the strip 31 transversely and into the assembly station of the machine.

Operation

After a cassette 21 is positioned in the machine, resting upon pins 49 on the four wheels 48 and also resting upon pin 70 and under pin 69, the latch 26 has been opened by the flattened surface 81 of one of the pins 69. Thereupon, the cylinder 86 (located at its rearward position) is actuated to advance the follower 87 the width of one strip. This pushes the front strip forwardly and onto the platen 101. After the cylinder 86 has been actuated a sufficient number of times, the forward-most strip engages the transverse bar 108. Thereupon, cylinder 126 is actuated so that pusher 134 pushes the strip laterally into the assembly station. Pusher 134 then retracts and cylinder 86 is actuated once again. This operation is repeated until all of the strips in cassette 21 have been removed. Follower 87 is then retracted.

Cylinder 56 is then actuated causing the arms 66 to swing out of the way of the cassette 21 and also causing hold-downs 118 to move forwardly so that fingers 123 are out of the way of the cassette. Thereupon, motor 51 is actuated to turn shafts 46 and 47 so that pins 49 control movement of a new cassette **21*a* into discharge position. Thereupon, cylinder 56 is actuated in the opposite direction to swing arms 66 inwardly, support 70 fitting under the next cassette 21*a* and pins 69 fitting over the cassette to prevent it from being lifted out of position. The flattened surface 81 at this point opens latch 26**.

Mounted on left-side frame 36 is a sensor 141 which by means of a fiber optic rod 142 extending through hole 143 in side frame 36 is connected to a mirror 144 which senses that the new cassette has been moved into position. If it does not sense a new cassette in position, the machine is stopped.

With the new cassette in place, cylinders 86 and 126 function in the same manner as heretofore described, moving all of the strips 31 in the cassette **21*a*** into the assembly station so that the operation may be continued with a new cassette.

Hopper for Cassettes for Male Strips

The spacing between cassettes 21 in a vertical stack of cassettes containing male strips 33 is necessarily larger than the spacing between cassettes containing female strips 31 by virtue of the need to accommodate the upstanding studs 34. This extra spacing is provided by making the spacer struts 24 higher in the male cassettes. Accordingly, as each male cassette is fed downwardly it must move a considerable distance greater than can be accommodated by the arcuate spacing between the outer ends of pins 49 on wheels 48.

Figure 6:
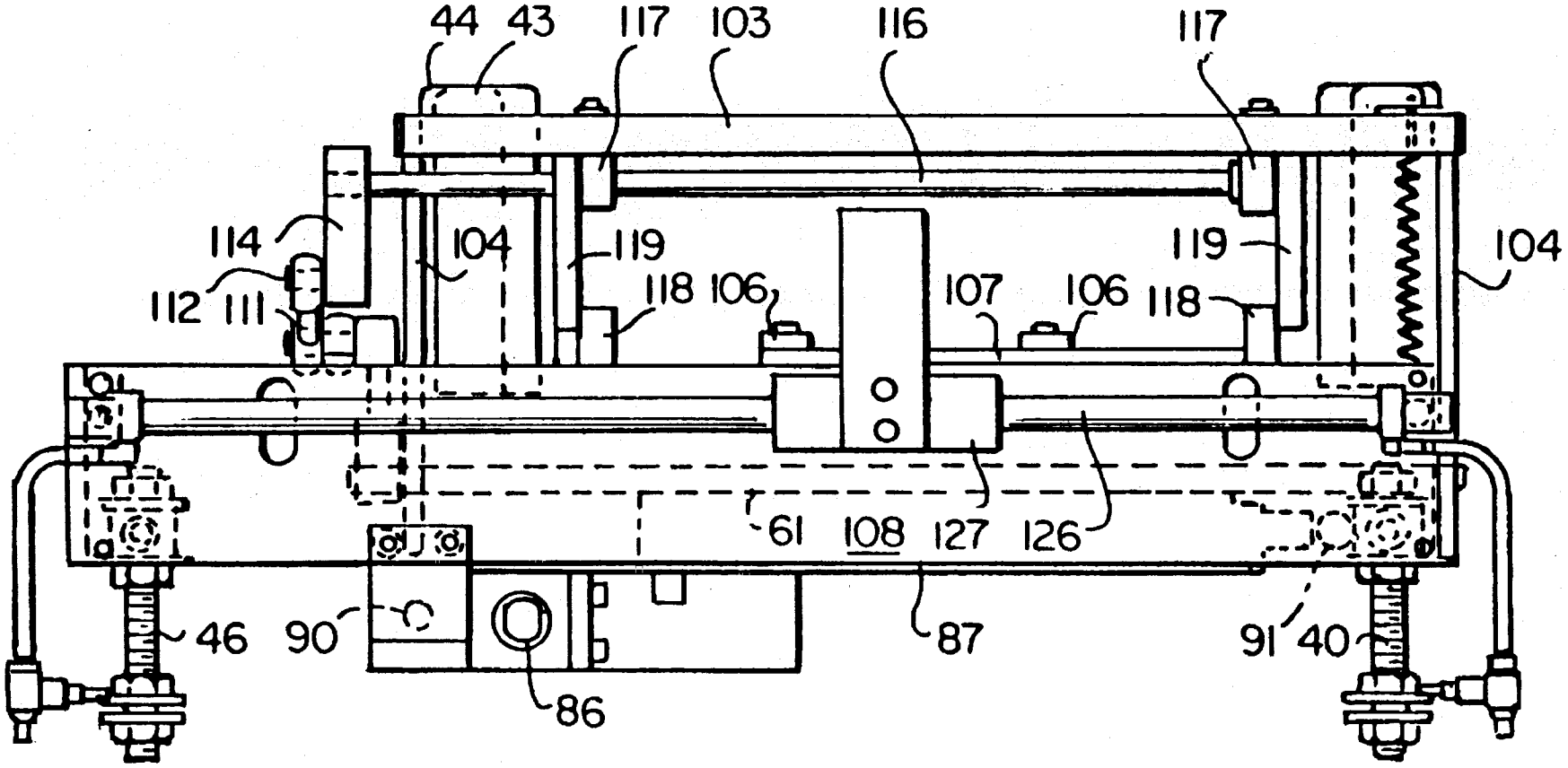
FIG. 6 is front elevational view as viewed substantially along the line 6—6 of FIG. 3.
Figure 7:
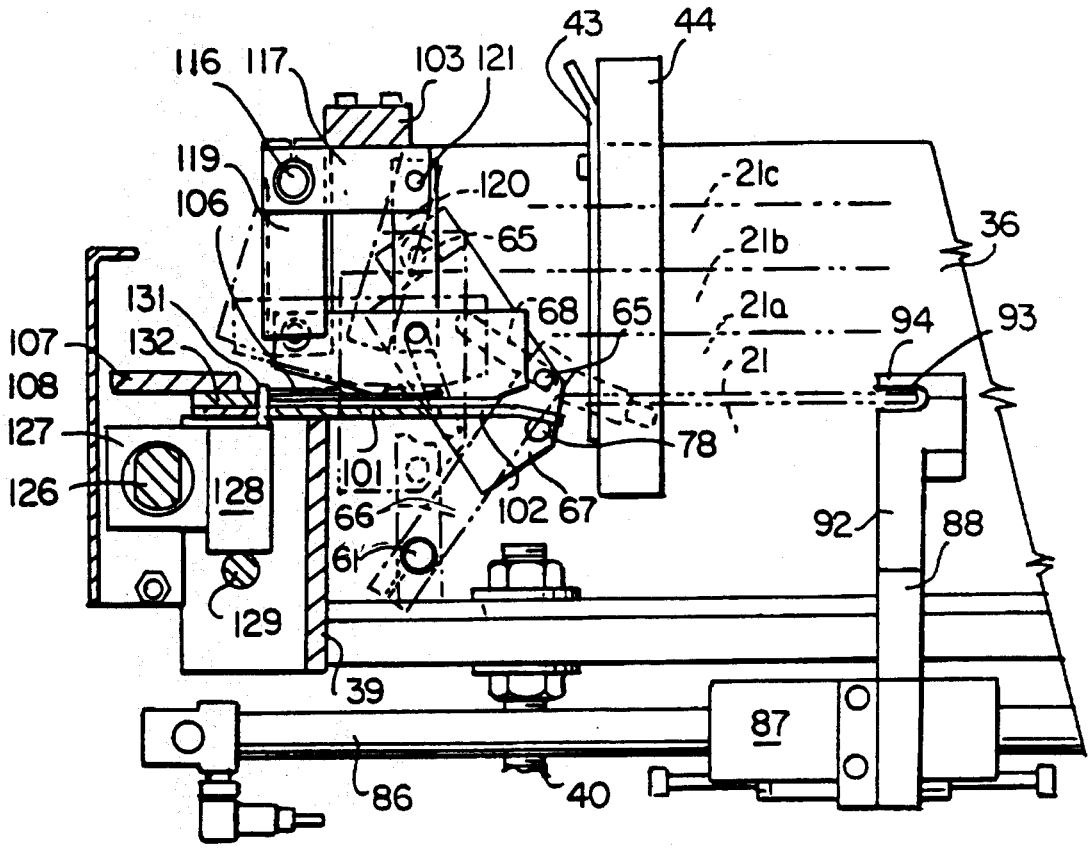
FIG. 7 is a sectional view taken substantially along the line 7—7 of FIG. 3.
Figure 8:
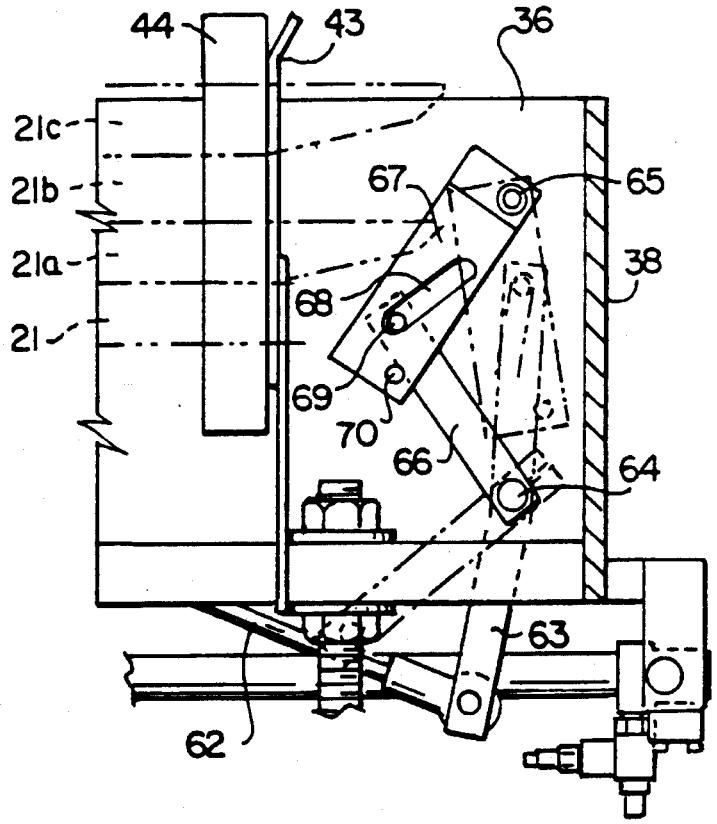
FIG. 8 is a sectional view taken substantially along the line 8—8 of FIG. 3.

Directing attention to FIGS. 14–17, it will be seen that the positions of many of the parts are reversed from those in FIG. 6. Whereas in FIG. 4 female strips are advanced into the assembly station to the right, in FIG. 15 the male strips are advanced to the left. The reason why bar 103, transverse shaft 116 and certain other elements of the modification of FIG. 3 et seq. are spaced well above the level of platen 101 and the female strips 31 is so that many of the parts of FIGS. 14–17 may be uniform in both hoppers. In many respects, the individual elements of FIGS. 14–17 resemble those of FIG. 3 et seq. and the same reference numerals followed by subscript "a" are used to designate corresponding parts.

Turning now to FIGS. 14–17 shafts 46*a* and 47*a* carry sprockets 151. Stub idler shafts 152 are mounted in side frames 36*a* and 37*a* above shafts 46*a*, 47*a* and carry sprockets 153. Chains 154 interconnect sprockets 151 and 153. At intervals equal to the spacing between male cassettes, pins 156 project longitudinally to engage the stacked male cassettes and feed them downwardly toward operative position.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A hopper for an automatic book-binding machine for use with a substantially rectangular cassette having parallel horizontal longitudinal members each formed with an inward facing channel, transverse horizontal spacer members spacing said longitudinal members a fixed distance apart and vertical spacer struts spacing said cassette a fixed vertical distance below a superimposed cassette, said cassette initially containing a plurality of thin, elongated binding strips, said strips having opposite ends each received in one said channel, said hopper comprising:

cassette feed means for feeding a vertical stack of superimposed cassettes vertically into said hopper, a plurality of cassette support means each having an operative position engaging under a lowermost cassette in said stack to support said cassette vertically and an inoperative position clear of said cassette to allow said cassette to drop from said hopper when said strips have been discharged therefrom, support activating means to move said cassette support means between operative and inoperative positions, longitudinal strip feed means comprising a carriage, means guiding said carriage for movement longitudinally of said hopper below a level of said cassette, at least one upright projecting up from said carriage to engage behind a rearmost strip in said cassette, means for moving said carriage longitudinally of said hopper step by step to push the rearmost strip and all strips forward thereof forwardly a distance equal to the width of one said strip to discharge one strip at a time from said cassette, a horizontal platen positioned to support said strips discharged from said cassette, a transverse horizontal bar adjacent the forward end of said hopper to limit forward movement of said strip, and transverse strip feed means to move said strips along said transverse horizontal bar laterally of said hopper one strip at a time.

2. A hopper according to claim 1 in which said cassette feed means for a vertical stack of superimposed cassettes comprises a pair of horizontal longitudinal shafts on opposite sides of said hopper, step drive means for turning both said shafts equi-angularly in opposite directions, mounting means on both of said shafts driven by said shafts, pins mounted on said mounting means, the spacing between adjacent pins equalling the vertical distance between said cassettes in said vertical stack, said pins being spaced apart a distance so that one of said pins fits under the lowermost cassette in said stack and a next one of said pins fits under a next lowermost cassette in said stack and a next one of said pins fits under a next lowermost cassette in said stack, whereby said step drive means turns said mounting means one step to lower said next lowermost cassette into a lowermost position in said stack.

3. A hopper according to claim 2 in which said mounting means comprises wheels on said shafts, said pins extending outwardly of said wheel, the distance between said pins equalling said vertical distance between said cassettes.

4. A hopper according to claim 2 in which said mounting means comprises a pair of second shafts mounted vertically above said pair of horizontal longitudinal shafts, sprockets and chains to turn each horizontal longitudinal shaft together with the corresponding second shaft above it, said pins being fixed to said chains, the distance between said pins equalling the vertical distance between said cassettes.

5. A hopper according to claim 1 in which said cassette support means for a vertical stack of superimposed cassettes comprises at least four links mounted about horizontal transverse axes for movement between an operative position and an inoperative position, said links being mounted in said hopper transversely outwardly of said vertical stack of cassettes, said support activating means swinging said links about said transverse axes between operative and inoperative positions, each said link having an inwardly extending support pin fitting under said lowermost cassette when said link is in operative position and remote from said lowermost cassette when said link is in inoperative position, two of said links being mounted on opposite sides of said cassettes adjacent forward ends of said cassettes and two of said links being mounted on opposite sides of said cassettes adjacent rearward ends of said cassettes.

6. A hopper according to claim 5 in which each said link carries an inwardly extending second support pin, said second pin fitting on top of a portion of said lowermost cassette to restrain upward movement of said lowermost cassette.

7. A hopper according to claim 6, wherein one said second pin engages a latch means provided on said cassette for restraining displacement of said strips from said cassette until said latch means is opened, in order to open said latch means as said links move into operative position.

8. A hopper according to claim 5 in which each said link is formed with a diagonal slot and in which said support actuating means comprises horizontal transverse shafts mounted in said hopper below said links, one said transverse shaft being below said links at the forward end of said cassettes and a second said transverse shaft being below said links at the rearward end of said cassette, arms on said transverse shafts, pins on said arms each extending into a slot in one said link, said support activating means oscillating said transverse shafts in opposite directions.

9. A hopper according to claim 8 in which said support activating means further comprises a second arm on each said transverse shaft, and a link interconnecting said second arms to oscillate said second arms in opposite directions.

10. A hopper according to claim 9 which further comprises a fluid cylinder for oscillating one said second arm.

11. A hopper according to claim 8 in which said cassette support means is in inoperative position when said links are substantially vertical and in operative position when said links slant inwardly relative to said lowermost cassette.

12. A hopper according to claim 1 in which said upright of said longitudinal strip feed means comprises a substantially vertical member having a forward edge formed with a slot extending horizontally rearwardly of said forward edge to form a finger on the upper end of said vertical member, said finger being located at the level of said strips in said lowermost cassette, said horizontal platen having a rearward edge positioned to fit into said slot as said carriage reaches it forwardmost position.

13. A hopper according to claim 1 which further comprises stationary guides extending longitudinally rearward from a front side of said hopper spaced above said platen to hold strips fed from said cassette in contact with said platen.

14. A hopper according to claim 1 which further comprises a hold-down foot having an operative position extending horizontally rearward from a front side of said hopper spaced above said platen to hold strips fed from said cassette in contact with said platen, said foot having a rear portion extending above said cassette and means to move said foot forwardly out of the path of a superimposed cassette moving into position as a lowermost cassette.

15. A hopper according to claim 14 in which said means to move said foot comprises a transverse shaft, oscillatory means to oscillate said transverse shaft, and a link fixed to said transverse shaft and pivoted to said foot.

16. A hopper according to claim 15 in which said oscillatory means comprises a second link fixed to said transverse shaft and means to oscillate said second link.

17. A hopper according to claim 16 in which said means to oscillate said second link is actuated by said support actuating means.

18. A hopper according to claim 1 in which said transverse strip feed means comprises transverse ways parallel to said transverse bar, a cylinder, a follower reciprocated by said cylinder along said ways between a retracted position and a projected position, said transverse bar being separated from said platen by a gap, and a pusher on said follower extending from said follower into said gap, said pusher being spaced from a first end of a strip in contact with said horizontal transverse bar, said pusher pushing against said first end of said strip to move said strip laterally of said hopper along said horizontal bar as said follower moves to projected position.

19. A hopper according to claim 1 which further comprises cassette guides to support a stack of superimposed cassettes above said cassette in operative position.

20. A hopper according to claim 1 which further comprises a sensor to sense the presence of a cassette in a lower most position and to enable said means for moving said carriage of said longitudinal strip feed means and said transverse strip feed means.

21. A method of feeding thin, narrow bookbinding strips packaged in a cassette having two parallel horizontal, longitudinal members each formed with an inward facing channel, transverse horizontal spacer members spacing said longitudinal members apart a fixed horizontal distance equal to the length of said strips and vertical spacer struts spacing said cassette from a superimposed cassette a fixed vertical distance and wherein the ends of a plurality of said strips are received in said channels, comprising inserting at least one cassette from the top into a hopper shaped to receive said cassette and strips packaged therein and locating said cassette in a discharge position, supporting said cassette within said hopper in discharge position by support means, longitudinally feeding said strips longitudinally of said cassette one at a time, supporting strips fed from said hopper on a platen, engaging strips on said platen against a transverse horizontal bar limiting horizontal longitudinal movement of said strips along said platen in a direction away from said cassette, traversely moving one strip at a time as said strip is engaged by said bar transversely along said bar away from said hopper.

22. A method according to claim 21 which further comprises feeding one cassette at a time vertically downward from a stack of cassettes in said hopper into discharge position while moving said support means to an inoperative position to permit an empty cassette to drop below said hopper.

23. A method according to claim 21 in which said step of feeding said strips comprises positioning a finger against a rear edge of a rearmost strip in said cassette and moving said rearmost strip and all strips in front of said rearmost strip longitudinally of said cassette in steps equal to the width of one strip.

24. A method according to claim 23 which further comprises holding said strips on said platen by pressing a hold-down foot against the tops of strips on said platen.

25. A method accordingly to claim 24 which further comprises moving said foot forwardly to an inoperative position when a cassette in said discharge position is empty to permit said last-mentioned cassette to be discharged from said hopper.

26. A method accordingly to claim 25 which further comprises moving said foot forwardly while simultaneously moving said support means to inoperative position.

27. A method according to claim 21 in which said cassette has a latch restraining displacement of strips from said cassette and which further comprises opening said latch after inserting said at least one cassette into discharge position.

28. A method according to claim 27 which further comprises moving said support means from an inoperative position to an operative position while simultaneously opening said latch.

29. A method according to claim 21 in which said step of transversely moving said strip comprises fluid drive means extending transversely of said hopper having a pusher extending vertically from said fluid drive means positioned to engage behind a strip engaged against said transverse horizontal bar and actuating said fluid drive means to move said pusher transversely to feed said strip transversely.

* * * * *